United States Patent [19]

Jumpeter

[11] Patent Number: 4,499,668

[45] Date of Patent: Feb. 19, 1985

[54] AUTOMATIC MINIMUM DIFFERENTIAL PRESSURE CONTROL FOR DRYER CYLINDERS

[75] Inventor: Alex Jumpeter, Lithonia, Ga.

[73] Assignee: Midland-Ross Corporation, Cleveland, Ohio

[21] Appl. No.: 554,936

[22] Filed: Nov. 25, 1983

[51] Int. Cl.[3] ..... F26B 3/28

[52] U.S. Cl. ..... 34/41; 34/48; 34/54; 34/119; 34/124

[58] Field of Search ..... 34/39, 41, 48, 119, 34/124, 54; 165/90

[56] References Cited

U.S. PATENT DOCUMENTS

| | | | |
|---|---|---|---|
| 1,192,369 | 7/1916 | Barrus . | |
| 1,572,448 | 2/1926 | Simons . | |
| 1,643,972 | 10/1927 | Woodsome . | |
| 2,208,784 | 7/1940 | Armstrong . | |
| 2,366,801 | 1/1945 | Olson . | |
| 2,811,787 | 11/1957 | Clements . | |
| 3,208,513 | 9/1965 | Pendleton . | |
| 3,237,685 | 3/1966 | Heisterkamp . | |
| 3,251,138 | 5/1966 | Whittaker . | |
| 3,748,224 | 7/1973 | Tillie et al. | 34/48 |
| 4,089,121 | 5/1978 | Sawyer . | |
| 4,106,211 | 8/1978 | Holik . | |
| 4,222,178 | 9/1980 | Moran . | |

*Primary Examiner*—Larry I. Schwartz
*Attorney, Agent, or Firm*—H. Duane Switzer

[57] ABSTRACT

A supply of steam is fed to a drying cylinder (10) from a steam line (20) through a steam pressure control valve (22). Condensate and steam are removed from the drying cylinder to a separator (32). The pressure of the removed steam is controlled by a steam pressure control valve (36) and the rate of condensate removal is monitored by a condensate removal monitor (48). A computer controller (16) adjusts the steam feed and removal pressure control valves to maintain the smallest differential pressure therebetween which will maintain the condensate removal rate substantially constant. The computer controller sets an initial pressure differential during an initializing step (50). In a first pressure differential adjustment step (52), the computer decreases the pressured differential in first increments until the condensate removal rate begins to decrease. In response to the decrease, the first pressure differential adjusting step increases the pressure differential by the first increment. A second pressure differential adjusting step (54) functions like the first pressure differential adjusting step but uses a smaller increment. A checking step (56) periodically increases the pressure differential by the second increment and returns the program to the second pressure differential adjusting step to reestablish an optimal pressure differential.

9 Claims, 2 Drawing Figures

AUTOMATIC MINIMUM DIFFERENTIAL PRESSURE CONTROL FOR DRYER CYLINDERS

BACKGROUND OF THE INVENTION

The present invention relates to the art of steam pressure regulation. More particularly, the invention relates to a method and apparatus for controlling steam flow through heated cylinders. The present invention finds particular application in conjunction with drying cylinders for paper making machinery and will be described with particular reference thereto. It is to be appreciated, however, that the invention is also applicable to other steam and condensable vapor heated structures.

In paper making machinery, the paper products are passed over a series of drying cylinders or drums. The drying cylinders are commonly heated by passing selected amounts of steam thereinto where the steam condenses into water condensate releasing its heat to the cylinder. During the removal of the condensate from the cylinder, some steam is also removed. Various systems have been developed for recovering and minimizing the amount of heat which is lost in steam removed with the condensate.

One system of controlling heat loss is disclosed in U.S. Pat. No. 4,222,178, issued September, 1980 to T. L. Moran. The Moran system seeks to maintain a preselected ratio between the flow rate of the condensate and the flow rate of the removed steam. Specifically, a controller compares the condensate and removed steam flow rate ratio with a preselected ratio for the current operating conditions, and controls an atmospheric relief valve in such a manner that the monitored ratio converges upon the selected ratio.

Others have monitored the temperature of the removed steam and condensate and utilized that monitored temperature to control the amount of steam fed to the drying cylinder. Also, others have suggested controlling the pressure differential between the inlet and the outlet of the drying cylinder in accordance with the amount or rate of the paper passing over the cylinder. Still others have adjusted the pressure of the removed steam as a function of the temperature of the removed steam and condensate.

The prior art control systems have tended to be relatively complex. Monitoring the flow rate of steam, for example, requires apparatus which is relatively expensive, yet relatively inaccurate. Further, steam flow measuring apparatus costs energy by creating a pressure loss.

The present invention contemplates a new and improved steam pressure control system for drying cylinders and the like which overcome the above referenced problems and others, yet maximizes the efficiency of steam usage.

SUMMARY OF THE INVENTION

In accordance with the present invention, a method of minimizing the quantity of steam blown through a drying cylinder or like structure is advantageously provided. The quantity of condensate removed from the cylinder is monitored, and in response to monitoring a steady state rate of condensate removal, the pressure differential across the cylinder is reduced. Such reduction continues until the minimum pressure differential which is capable of maintaining the steady state condensate removal condition is achieved.

In accordance with a more limited aspect of the present invention, the method further includes periodically checking to be sure that the steady state condition is continuing to occur. More specific to the preferred embodiment, the pressure differential is periodically increased to determine whether the amount of condensate increases. If the amount of condensate does not increase, the pressure differential is reduced until a minimum pressure differential is again achieved.

In accordance with another aspect of the present invention, there is provided a drying cylinder, steam feeding means for feeding steam to the drying cylinder, fluid removal means for removing steam and condensate from the drying cylinder, removed steam pressure controlling means for controlling the pressure of the removed steam, condensate monitoring means for monitoring the quantity of removed condensate, verifying means for verifying that the monitored rate of condensate removal is substantially constant, and pressure differential control means for controlling a pressure differential between the feed and removed steam. The pressure differential control means varies the pressure differential in response to the verifying means failing to verify a steady condensate removal rate.

One advantage of the invention is that it removes a maximum amount of condensate with the minimum pressure differential across the drying cylinder.

Another advantage of the invention is that it minimizes steam loss without monitoring the steam flow rate.

Still further advantages of the invention will become apparent to others upon reading and understanding the following detailed description of the preferred embodiment.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
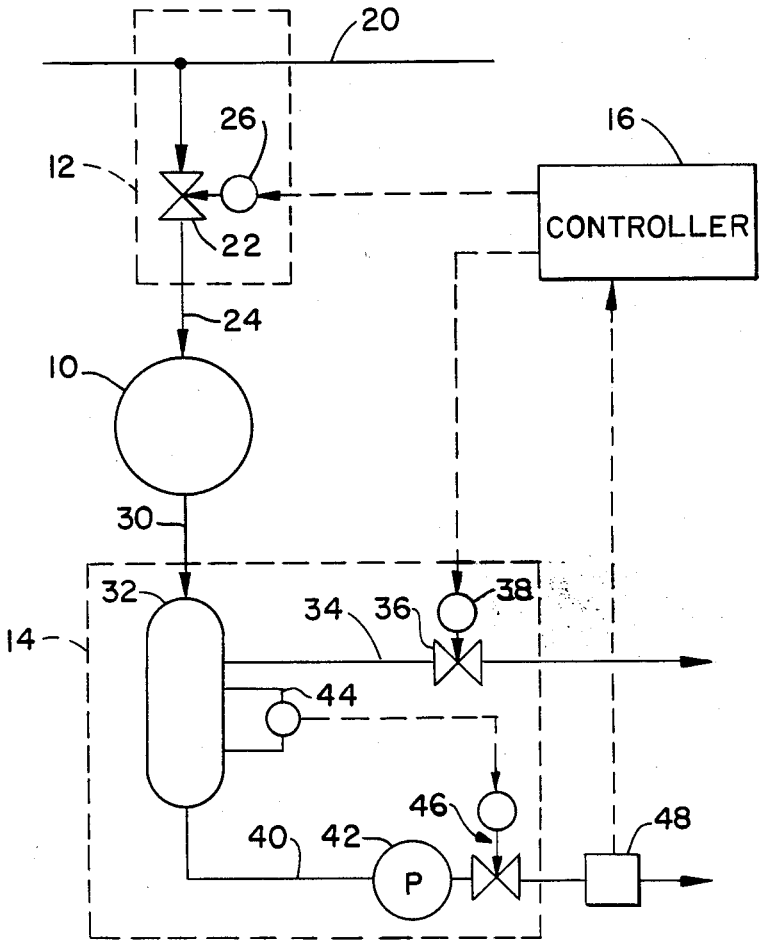
FIG. 1 is a diagrammatic illustration of a drying cylinder such as used in a paper making process in conjunction with associated steam feeding, steam and condensate collection, and control apparatus formed in accordance with the present invention; and, FIG. 2 is a flowchart for computerized control of the apparatus shown in FIG. 1.

Referring now to the drawings wherein the showings are for purposes of illustrating the preferred embodiment of the invention only and not for limiting same, FIG. 1 shows a supply of steam fed to a steam heated structure 10, such as a drying cylinder, by a steam feeding means 12 at a controllable rate. As the steam gives up its heat to the drying cylinder, it condenses into water or condensate. A fluid removal means 14 removes the condensate along with some steam from the cylinder. The steam feeding means and the fluid removal means each controls the pressure of the steam passing therethrough. In this manner, the steam feeding means and the fluid removal means set a steam pressure differential across the drying cylinder.

A controller 16 is operatively connected with the steam feeding means and fluid removal means to control the pressure differential as a function of the condensate removal rate. More specifically, the controller reduces or optimizes the differential pressure to a minimum differential pressure at which substantially all condensate is removed from the drying cylinder. Thereafter, the controller maintains the pressure differential to substantially the lowest pressure differential which successfully removes substantially all condensate.

When all of the condensate is being removed, the condensate removal rate is independent of the differential pressure, ie., the condensate removal rate remains constant with changes in the differential pressure. If the differential pressure becomes too small to remove all of the condensate, the condensate removal rate decreases. As explained in greater detail below, to minimize the pressure differential, the controller 16 decreases the pressure differential until the condensate removal rate decreases, ie., until the differential pressure becomes too small. When the condensate removal rate starts decreasing, the differential pressure is increased by an amount which is sufficient to cause the condensate removal rate to become constant.

In the preferred embodiment, the steam feeding means 12 includes a main steam feed line 20 which is connected with a boiler or other source of steam (not shown). A steam line pressure control valve 22 controls the feed pressure of steam in a feed line 24 which feeds the steam into the drying cylinder 10. The feed pressure control valve 22 is operated by an electromechanical servomechanism 26 under the control of the control means 16.

The fluid removal means 14 includes a discharge line 30 which is connected with a syphon or other mechanism (not shown) within the drying cylinder for removing the condensate. The discharge line is connected with a steam/condensate separator 32. Steam is removed from the top of the separator along steam discharge line 34 at a pressure which is controlled by a removed steam pressure control valve 36. The removed steam pressure control valve 36 is operated by an electromechanical servomechanism 38 under the control of the control means 16. The removed steam pressure control valve 36 vents the removed steam to the atmosphere, passes it to other drying cylinders, returns it to the steam supply, or the like, as is conventional in the art.

A condensate removal or discharge line 40 and a condensate pump 42 return the condensate to the boiler or the like, as is conventional in the art. A condensate level control means 44 monitors the level of condensate in the separator 32 and controls the degree of throttling of a discharge valve 46. Rising and falling condensate levels in the separator indicate that the condensing rate is varying. The level control means 44 opens and closes the throttle valve to a greater or lesser degree to control the flow rate therethrough such that the separator level remains substantially constant. A flow meter or other condensate removal monitor 48 monitors the flow through the discharge valve 46, ie., monitors the condensate removal or discharge rate. The flow meter 48 produces a flow rate output signal which varies in proportion to the condensate removal rate. The flow rate signal is conveyed to the control means 16 to be used in implementing a pressure differential control algorithm.

In normal operation, the condensate is removed or discharged at a constant rate, ie., a steady state removal condition. A variation in the condensate removal rate generally connotes a change in operating conditions. If the removal rate fails to return to the steady state, ie., a constant removal rate, after an operating condition change, condensate is normally accumulating in the cylinder. To remove the accumulation from the cylinder and return to the steady state condensate removal condition, the steam pressure differential is adjusted by the control means 16.

Figure 2:
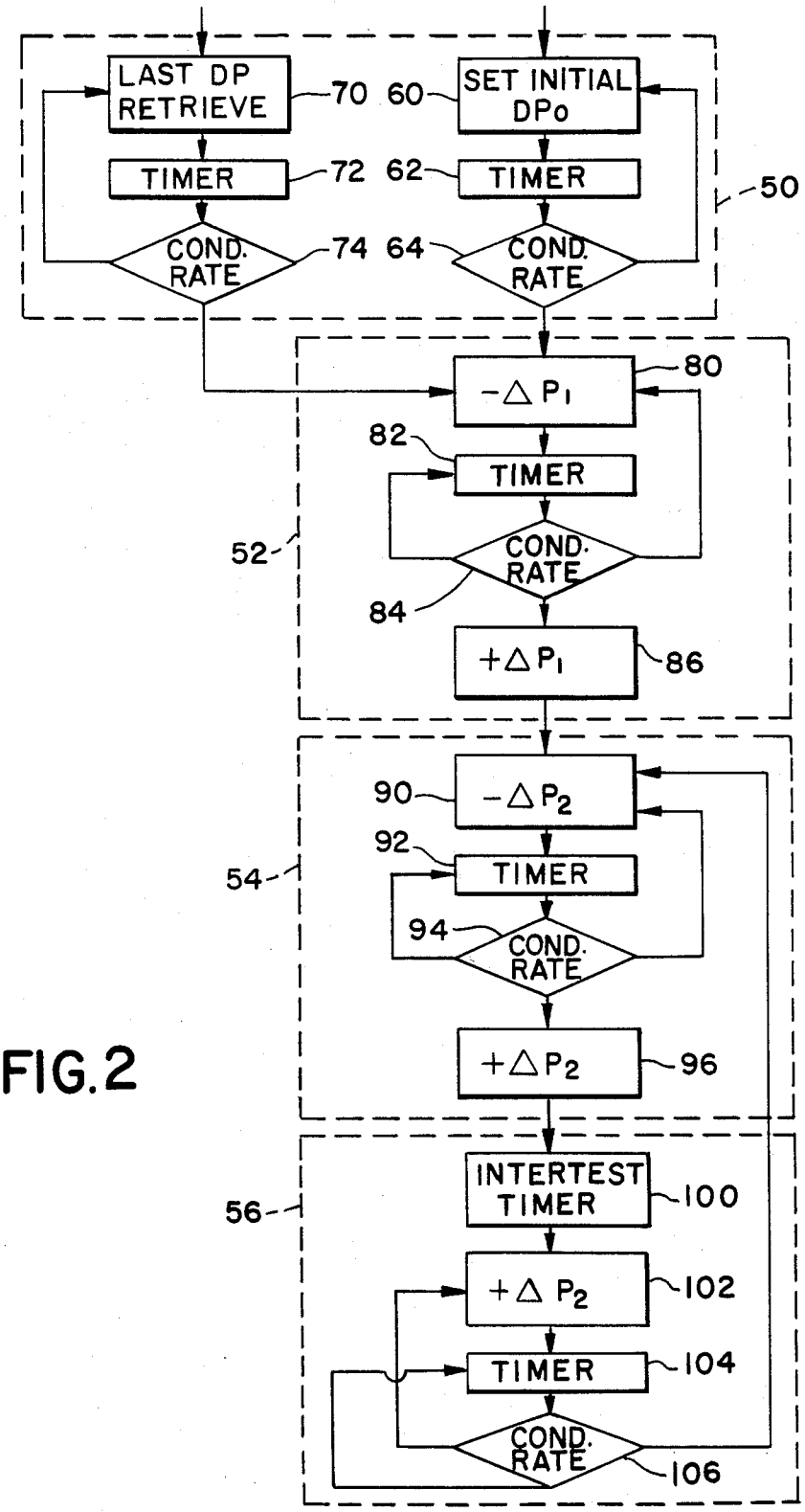

With particular reference to FIG. 2, the controller 16 in the preferred embodiment includes a minicomputer which monitors the condensate removal or discharge rate from the flow meter 48 and controls the steam feed and removal pressure differential in accordance therewith. The computer is programmed with a suitable software programming that performs and includes an initializing step or means 50 for selecting an initial differential pressure for use during start-up or restart after a paper product sheet breaks. In the preferred embodiment, the initial differential pressure is relatively high, sufficiently high that achieving the steady state condensate removal condition is assured under normal operating conditions.

A coarse or large first increment differential pressure adjustment step or means 52 adjusts the differential pressure in relatively large or coarse first increments toward the optimal differential pressure, ie., the minimum differential pressure which removes substantially all of the condensate from the drying cylinder. In the preferred embodiment, the first adjustment means decreases the initial differential pressure in relatively large first increments or steps toward the optimal differential pressure. The first adjustment means reduces the differential pressure until it falls below the optimal differential pressure and condensate starts accumulating in the cylinder. Then, the first adjustment means increases the differential pressure by one first increment.

After the first differential pressure adjustment step or means 52 brings the differential pressure to approximately the optimal differential pressure, a fine or small second increment differential pressure adjustment means or step 54 further adjusts differential pressure toward the optimal differential pressure. The second adjustment is conducted in second increments or steps which are relatively small compared to the first increments. In the preferred embodiment, the second adjustment reduces the pressure differential in the small second increments until it falls below the optimal differential pressure. Then, it increases the differential pressure by one second increment. In this manner, the actual steady state differential pressure is within one second increment of the theoretically optimal differential pressure.

A condensate removal check means 56 periodically checks to determine whether substantially all condensate is being removed. In the preferred embodiment, the condensate check means periodically increases the differential pressure. If substantially all the condensate is being removed, increasing the differential pressure will not result in an increase in the condensate removal rate. However, if substantially all of the condensate was not being removed, the increase in differential pressure will cause a corresponding increase in the condensate removal rate. The condensate removal check step or means artifically increases the differential pressure and monitors for a change in the condensate removal rate to determine whether or not substantially all condensate is being removed. If substantially all the condensate is being removed, the second differential pressure adjustment means 54 readjusts and returns the actual differential pressure to the steady state differential pressure.

The initializing step or means 50 includes a step or means 60 for setting an initial differential pressure. In the preferred embodiment, this includes a keyboard or the like on which an operator can enter a preselected initial differential pressure. Once entered, the initial differential pressure can be stored in a memory and retrieved at the start of each run. The most recent differential pressure of the current run may also be stored and retrieved as the initial differential pressure after a temporary stoppage or at the beginning of the next run of the same type.

A timing step or means 62 provides a preselected time delay after the beginning of the run for the actual condensate removal rate to stabilize. After the stabilization time delay, an initial rate of condensate removal determining means 64 determines whether the condensate removal rate is substantially constant. The condensate removal rate determination may be made by reading the output from pump rate controller 46 two or more times and comparing the read rates to determine if they are substantially the same, are increasing, or are decreasing. If the condensate removal rate is increasing or decreasing, the initial differential pressure change determining means returns to the initializing differential pressure setting means or step 60 and the initializing timing means or step 62 to provide another stabilization delay. If the initializing condensate removal rate determining means 64 determines that the amount of condensate being removed is substantially constant, ie., substantially all condensate is being removed, the first differential adjustment means or step 52 is actuated.

When a sheet breaks during a run, a differential pressure retrieving means or step 70 retrieves the most recent prebreak differential pressure which produced steady state condensate removal. A sheet break timing means or step 72 provides a preselected stabilization time delay and actuates a sheet break condensate removal rate determining means or step 74. The sheet break condensate removal rate determining means or step determines whether the condensate removal rate is steady or varying. If the condensate rate is varying, the program returns to the retrieval and timing steps or means to provide another stabilization delay. Optionally, the differential pressure may be incremented if the condensate removal rate fails to stabilize. If the condensate removal rate is substantially constant, the first differential adjustment step or means 52 is actuated.

The first differential pressure adjustment step or means 52 includes a first decrementing means or step 80 which decreases the differential pressure by a preselected, relatively large first differential pressure increment, $\Delta P_1$. The first differential pressure increment is selected to be about 10 to 20 percent of the initial differential pressure. A first adjustment timing step or means 82 times a first stabilization interval, after which it actuates a first adjustment condensate rate determining means or step 84. If the condensate removal rate is substantially constant, the rate determining step or means returns to the first decrementing step or means 80, and differential pressure is decreased by the first increment. That is, if the monitor means 84 determines that substantially all of the condensate is being removed with the present differential pressure, the differential pressure is again decremented by the first increment. If the condensate flow rate is increasing, the first adjustment timing step or means 82 is reactivated so that the controller waits the first stabilization interval again. After another stabilization interval, the condensate flow rate is again determined. If the condensate flow rate is decreasing, which indicates that the differential pressure is insufficient to remove all the condensate, then a first adjustment incrementing means or step 86 increases the differential pressure by the first increment, $\Delta P_1$.

The fine adjustment step or means 54 includes a second or fine pressure differential decrementing means or step 90 which decreases the differential pressure by a second preselected differential pressure increment, $\Delta P_2$. In the preferred embodiment, the second pressure increment is approximately one quarter of the first increment. A second adjustment timing step or means 92 times a second adjustment stabilization interval, after which it actuates a second adjustment condensate rate determining means or step 94. If the condensate removal rate is substantially constant, the second rate determining step or means 94 returns to the second decrementing step or means 90, and the differential pressure is decreased again by the second differential pressure increment. That is, if the second rate determining step or means 94 determines that substantially all of the condensate is being removed with the present differential pressure, the differential pressure is decremented by the second pressure increment. If the condensate flow rate is increasing, the fine adjustment timing step or means 92 is repeated, and the controller waits another stabilization duration for the condensate flow rate to stabilize. If the condensate flow rate is decreasing, which indicates that the differential pressure is insufficient to remove all the condensate, a second differential pressure incrementing means or step 96 increases the differential pressure by the second increment, $\Delta P_2$. With this increase in the differential pressure, substantially the minimum differential pressure which is capable of removing substantially all the condensate has been attained. More specifically, the resultant optimal pressure differential is within the second differential pressure increment of the theoretical minimum. This small deviation allows for minor fluctuations in the operating conditions without necessitating readjustment.

The condensate removal check step or means 56 includes an intertest timer or hold means or step 100 which times for an extended between test duration after the optimal differential pressure has been attained in the second adjustment step or means. After the intertest duration, a check differential pressure incrementing means or step 102 increments the differential pressure. In the preferred embodiment, the check incrementing means increments the differential pressure by the second pressure increment. A check timing means or step 104 times a sufficient interval for the condensate removal rate to stabilize. A check condensate removal rate determining means or step 106 determines whether the condensate removal rate is constant. If the condensate removal rate remains substantially constant, indicating that all of the condensate is being removed, the program returns to the second adjustment means or step 54. The second adjustment means or step repeatedly decreases the differential pressure by the second increment until the minimum differential pressure is passed and increments it one second increment.

If the condensate flow rate is increasing, indicating insufficient differential pressure to remove all the condensate, the program returns to the check pressure incrementing means or step 102 and increments the differential pressure another time by the second pressure increment, and the process is then repeated. If the condensate removal rate is decreasing, indicating an unstable condition, the condensate rate determining means returns to the check timing means or step 104 to provide an additional duration for the system to stabilize.

The invention has been described with reference to the preferred embodiment. Obviously, modifications and alterations will occur to others upon a reading and understanding of the preceding detailed description. It is intended to include all such modifications and alterations insofar as they come within the scope of the appended claims or the equivalents thereof.

Having thus described the invention, it is now claimed:

1. A method of minimizing a differential steam pressure across a drying cylinder without measuring steam flow rate, there being steam feed means for feeding steam to the drying cylinder at a controllable feed pressure, fluid removal means for removing condensate and steam from the drying cylinder at a controllable removal pressure, control means for controlling the steam feed means and fluid removal means to control the differential steam pressure across the drying cylinder, and condensate monitoring means for monitoring the quantity of removed condensate, the method comprising:

(a) monitoring a rate of change of removed condensate;

(b) determining whether the condensate removal rate is substantially constant;

(c) if the condensate removal rate is substantially constant, decreasing the pressure differential is preselected, differential pressure increments until a pressure which is insufficient to maintain the condensate removal rate constant is attained, and increasing the pressure differential substantially by one of the preselected pressure differential increments, whereby the pressure differential is decreased in the preselected incremental steps to the first incremental step which fails to maintain a constant condensate removal rate and then is increased to the preceding incremental step which is the lowest first incremental step that maintains the constant condensate removal rate; and, (d) periodically checking whether the obtained pressure differential is just maintaining the condensate flow rate constant, whereby the steam pressure differential is minimized without measuring steam flow rates.

2. A method of minimizing a differential steam pressure across a drying cylinder, there being steam feed means for feeding steam to the drying cylinder at a controllable feed pressure, fluid removal means for removing condensate and steam from the drying cylinder at a controllable removal pressure, control means for controlling the steam feed means and fluid removal means to control a differential pressure across the drying cylinder, and condensate monitoring means for monitoring the quantity of removed condensate, the method comprising:

(a) monitoring a rate of change of removed condensate;

(b) determing whether the condensate removal rate is substantially constant;

(c) if the condensate removal rate is substantially constant, decreasing the pressure differential in preselected, first differential pressure increments until a pressure which is insufficient to maintain the condensate removal rate constant is attained;

(d) increasing the pressure differential by generally the first pressure differential increment, whereby the pressure differential is decreased in first incremental steps to the first incremental step which fails to maintain a constant condensate removal rate and then is increased to the preceding first incremental step which is the lowest first incremental step that maintains the constant condensate removal rate;

(e) after the step of increasing the pressure differential by the first differential pressure increment, decreasing the pressure differential by a second pressure differential increment which is smaller than the first pressure differential increment until the condensate removal rate decreases;

(f) increasing the pressure differential by the second increment, whereby the minimum differential pressure which maintains the condensate removal rate constant is determined to within the second pressure differential increment; and (g) periodically checking whether the obtained pressure differential is just maintaining the condensate flow rate constant.

3. The method as set forth in claim 2 wherein the second differential pressure increment is approximately one quarter of the first pressure differential increment.

4. A method of minimizing a differential steam pressure across a drying cylinder, there being steam feed means for feeding steam to the drying cylinder at a controllable feed pressure, fluid removal means for removing condensate and steam from the drying cylinder at a controllable removal pressure, control means for controlling the steam feed means and fluid removal means to control a differential pressure across the drying cylinder, and condensate monitoring means for monitoring the quantity of removed condensate, the method comprising:

(a) monitoring a rate of change of removed condensate;

(b) determining whether the condensate removal rate is substantially constant;

(c) reducing the pressure differential to obtain a minimal pressure differential which just maintains the condensate removal rate constant;

(d) periodically checking whether the obtained pressure differential in step (c) is just maintaining the condensate flow rate constant by increasing the pressure differential by a preselected pressure differential and determining whether the condensate removal rate remains constant;

(e) if the condensate removal rate remains constant, repeating the pressure differential reducing step (c); and, (f) if the condensate removal rate increases, repeating the pressure differential increasing step (d) until a substantially constant differential flow rate is attained.

5. A method of minimizing the amount of steam blowing through a steam heated structure, there being steam feed means for feeding steam to the heated structure at a controllable feed pressure, fluid removal means for removing steam and condensate from the heated structure, removed steam pressure controlling means for controlling pressure of the removed steam, a steam pressure differential being defined as the difference between the steam feed pressure and the removed steam pressure, and condensate monitor means for monitoring the quantity of removed condensate, the method comprising:

(a) initially setting the pressure differential;

(b) periodically reminimizing the pressure differential with a preselected periodicity, the pressure differential reminimizing including:

(i) increasing the pressure differential;

(ii) monitoring the rate of condensate removal;

(iii) determining whether the monitored condensate removal rate is generally constant;

(iv) in response to the monitored condensate removal rate being constant, reducing the pressure differential by increments and repeating steps (ii) and (iii), and the pressure differential reducing step until the condensate removal rate decreases;

(v) in response to the monitored condensate removal rate decreasing, increasing the pressure differential incrementally such that the monitored and condensate removal rate becomes constant, whereby the pressure differential is periodically increased artifically above the minimum and the pressure differential is reset to reminimize the pressure differential.

6. An apparatus for minimizing the amount of steam blowing through a drying cylinder, the apparatus comprising:

steam feeding means for feeding steam to the drying cylinder at a controllable feed pressure;

fluid removal means for removing condensate and steam from the drying cylinder, the fluid removal means including removed steam pressure adjusting means for the pressure of the removed steam and means for monitoring the rate of condensate removal from the drying cylinder;

control means for adjusting at least one of the feed and removed steam pressures so as to adjust a pressure differential therebetween, the control means being operatively connected with the condensate removal monitoring means for adjusting the differential pressure in response to the condensate removal rate, the control means including:

initializing means for selecting an initial differential pressure; and, differential pressure adjusting means for reducing the differential pressure to a minimal differential pressure which maintains the condensate removal rate substantially constant;

checking means for checking whether the pressure differential is substantially a minimum pressure differential which maintains the condensate removal rate substantially constant, the checking means including:

check pressure incrementing means for incrementing the differential pressure by a preselected increment;

check condensate rate determining means for determining whether the condensate removal rate increases in response to the increased pressure differential, the check condensate rate determing means being responsive to an increase in the condensate removal rate to cause the check pressure incrementing means to increment the differential pressure and being responsive to the condensate removal rate holding substantially constant to enable the differential adjusting means to reduce the differential pressure.

7. The apparatus as set forth in claim 6 wherein the differential pressure adjusting means includes:

first means for reducing the differential pressure by a first increment; and, first condensate removal rate determining means for determining changes in the condensate removal rate, the first condensate removal rate determining means being responsive to the condensate removal rate remaining constant to cause the first differential pressure reducing means to reduce the differential pressure by the first increment and being responsive to a reduction in the condensate flow rate to cause a first pressure differential incrementing means to increment the pressure differential by the first increment.

8. The apparatus as set forth in claim 7 further including:

second differential pressure reducing means for reducing the differential pressure by a second increment; and, second condensate removal rate determing means for determining any change in the condensate removal rate, the second condensate removal rate determining means being responsive to the condensate removal rate remaining constant to cause the second differential pressure reducing means to reduce the differential pressure by the second increment and being responsive to a reduction in the condensate flow rate to cause a second pressure differential increment means to increment the pressure differential by the second increment.

9. The apparatus as set forth in claim 8 wherein the check means includes:

an intertest timing means for timing an intertest duration, the check pressure incrementing means being responsive to the intertest timing means to increment the pressure differential after each intertest duration.

* * * * *